US006132173A

United States Patent [19]

Tomita et al.

[11] Patent Number: 6,132,173

[45] Date of Patent: Oct. 17, 2000

[54] COOLED PLATFORM FOR A GAS TURBINE MOVING BLADE

[75] Inventors: Yasuoki Tomita; Hiroki Fukuno; Kenichi Arase; Toshiaki Sano, all of Takasago, Japan

[73] Assignee: Mitsubishi Heavy Industries, Ltd., Tokyo, Japan

[21] Appl. No.: 09/042,701

[22] Filed: Mar. 17, 1998

[30] Foreign Application Priority Data

Mar. 17, 1997 [JP] Japan ..... 9-062990

[51] Int. Cl.[7] ..... F01D 5/18

[52] U.S. Cl. ..... 416/96 R; 415/114; 415/115

[58] Field of Search ..... 415/114, 115, 415/116, 117; 416/95, 96 R, 96 A, 97 R; 60/39.75

[56] References Cited

U.S. PATENT DOCUMENTS

| | | | |
|---|---|---|---|
| 3,066,910 | 12/1962 | Bluck | 416/96 R |
| 4,063,851 | 12/1977 | Weldon | 416/97 A |
| 4,312,625 | 1/1982 | Pinaire . | |
| 5,320,483 | 6/1994 | Cunha et al. . | |
| 5,634,766 | 6/1997 | Cunha et al. | 415/115 |
| 5,639,216 | 6/1997 | McLaurin et al. | 416/95 |
| 5,813,835 | 9/1998 | Corsmeier et al. | 416/97 R |
| 5,848,876 | 12/1998 | Tomita | 416/96 R |
| 5,980,202 | 11/1999 | Tomita et al. | 415/115 |
| 6,019,579 | 2/2000 | Fukuno et al. | 416/97 R |

FOREIGN PATENT DOCUMENTS 0 392 664 3/1989 European Pat. Off. .

OTHER PUBLICATIONS

European Search Report for EP 98 30 1896 completed Jan. 14, 1999 by F. Raspo.

Patent Abstracts of Japan, vol. 10, No. 249 (M–511), Aug. 27, 1986.

Patent Abstracts of Japan, vol. 97, No. 1, Jan. 31, 1997.

*Primary Examiner*—Christopher Verdier
*Attorney, Agent, or Firm*—Alston & Bird LLP

[57] ABSTRACT

A cooled platform for a gas turbine moving blade which enables the platform to be cooled when the moving blade is cooled by steam. The moving blade is provided with a plurality of steam passages. Steam is introduced from the steam passage at the trailing edge portion, flows in a serpentine passage composed of other steam passages to cool the blade, and flows out to a blade root portion from a base portion of the steam passage at the leading edge portion, being recovered. Part of steam flowing into the platform from the base portion of the steam passage at the trailing edge portion enters first and second steam passages in the platform. On one side, the steam passes through first, third, and fourth steam passages, and on the other hand, the steam passes through second, fifth, and sixth steam passages. The steam is recovered together with the steam having cooled the blade at the base portion of steam passage at the leading edge portion. Therefore, the peripheral portion of a platform can be cooled by steam, air is not needed, and the platform can be cooled by steam when the steam cooling system is used to cool the blade.

4 Claims, 3 Drawing Sheets

COOLED PLATFORM FOR A GAS TURBINE MOVING BLADE

FIELD OF THE INVENTION AND RELATED ART STATEMENT

The present invention relates to a cooled platform for a gas turbine moving blade, in which the peripheral portion of the platform is cooled effectively by using steam.

FIG. 4 shows the interior of a conventional gas turbine moving blade using a typical air cooling system. In this figure, reference numeral 11 denotes a moving blade, 12 denotes a platform for the moving blade 11, and 13A, 13B, 13C, 13D and 13E denote air passages in the blade. Turbulators 14 are provided on the inside wall of each of the air passages to make the air flow turbulent and increase the heat transmission. Reference numeral 15 denotes a blade root portion. Cooling air 18-1, 18-2 and 18-3 flows into the blade from the lower part of the blade root portion 15.

In the moving blade 11 configured as described above, cooling air 18-1 enters the air passage 13A and flows out through air holes (not shown) at the trailing edge to perform slot cooling 17. Cooling air 18-2 enters the air passage 13D, flows into the air passage 13C from the tip end portion, further flows into the air passage 13B from the base portion, flowing out through air holes (not shown) in this process, and is discharged from the tip end portion while performing film cooling. Cooling air 18-3 enters the air passage 13E at the leading edge portion, and flows out through air holes (not shown) at the leading edge as it flows toward the tip end portion to perform shower head cooling 16. Thus, a large quantity of air is required to cool the blade, so that some of air in the rotor cooling system is supplied to perform cooling.

On the other hand, in most cases, the platform 12 is not cooled specially. When the platform 12 is cooled, holes are formed in the platform, and part of cooling air for cooling the blade is introduced into these holes, allowed to flow therein, and discharged to the outside from the end portion of platform. FIG. 5, which is a plan view of the platform 12 for the moving blade 11 shown in FIG. 4, shows one example of a cooled platform.

As shown in FIG. 5, the moving blade 11 is provided with the aforementioned air passages 13A, 13B, 13C, 13D and 13E, and cooling air flows in these air passages. The platform 12 is formed with air holes 20 and 22 for taking in part of cooling air flowing into the air passage 13E. Also, the platform 12 is formed with air holes 21 and 23 which communicate with the air holes 20 and 22, respectively, and extend toward the trailing edge. The air holes 21 and 23 are open to the trailing edge side. The cooling air taken in from the air passage 13E at the leading edge portion passes through the air holes 20 and 21 and 22 and 23, flowing at both sides of the platform 12 to cool the platform 12, and is discharged to the trailing edge side.

As described above, in the conventional gas turbine moving blade, a large quantity of cooling air is always allowed to flow to cool the blade. Therefore, considerable power is consumed to operate a compressor for providing a high pressure of air and a cooler, leading to a decrease in gas turbine performance.

In recent years, a combined system which increases the power generating efficiency by combining a gas turbine with a steam turbine has been realized, and it is thought to use a system in which in place of air used for cooling the blade, part of steam generated in the steam turbine is extracted and introduced to the blade. At present, however, this steam cooling system has not yet been used practically.

OBJECT AND SUMMARY OF THE INVENTION

An object of the present invention is to provide a cooled platform for a gas turbine moving blade, in which when a steam cooling system is used in place of the conventional air cooling system to cool the blade and the blade has a cooling construction suitable for steam cooling, the platform also has a construction capable of being steam-cooled, and air is never used for cooling the moving blade, by which the gas turbine performance can be increased.

To achieve the above object, the present invention provides the following means.

In a platform for a gas turbine moving blade, in which steam passages are provided in the blade and steam is allowed to flow in the passage to cool the blade, steam passages are formed in a platform around the portion of the platform where the blade is located, and the steam passages in the platform are connected to the steam passage in the blade to allow steam to flow in the platform.

In the cooled platform for a gas turbine moving blade, steam is taken into the platform from the steam passage in the moving blade, and allowed to flow in the steam passages formed in the platform to cool the peripheral portion of platform, so that air is not needed. Therefore, when a steam cooling system is used in place of the air cooling system to cool the blade, the platform for the moving blade can also be cooled by steam flowing into the platform from the base portion of moving blade. Therefore, air is not needed to cool the moving blade, leading to an increase in gas turbine performance.

As described in detail above, according to the present invention, in a platform for a gas turbine moving blade, in which steam passages are provided in the blade and steam is allowed to flow in the passage to cool the blade, steam passages are formed in a platform around the portion of the platform where the blade is located, and the steam passages in the platform are connected to the steam passage in the blade to allow steam to flow in the platform, so that steam can easily be taken into the platform from the steam passage of blade. Therefore, when a steam cooling system is used in place of the air cooling system to cool the blade, the platform can also be cooled by steam. Thereupon, the use of air can be eliminated from the moving blade cooling system, which contributes to the increase in gas turbine performance.

DETAILED DESCRIPTION OF PREFERRED EMBODIMENTS

Figure 1:
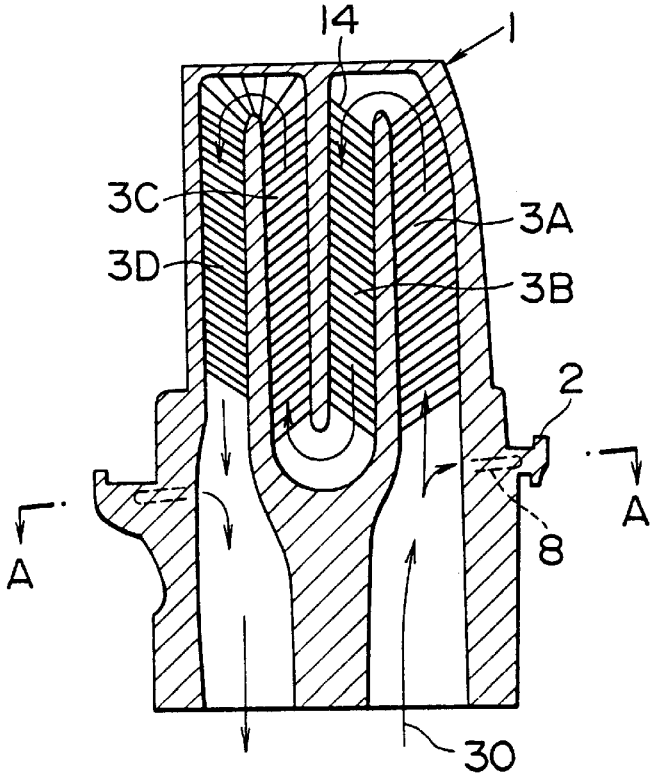
FIG. 1 is a sectional view of the interior of a moving blade to which a cooled platform for a gas turbine moving blade in accordance with one embodiment of the present invention is applied.

An embodiment of the present invention will be described in detail below with reference to the accompanying drawings. FIG. 1 is a sectional view of the interior of a moving blade to which a cooled platform for a gas turbine moving blade in accordance with one embodiment of the present invention is applied, FIG. 2 is a sectional view taken along the line A—A of FIG. 1, showing a cooling construction of platform, and FIG. 3 is a sectional view taken along the line B—B of FIG. 2.

FIG. 1 shows a case where a steam cooling system is used for cooling the moving blade 1. The moving blade 1 is provided with steam passages 3A, 3B, 3C and 3D extending from the base portion to the tip end portion, and these steam passages 3A to 3D constitute a serpentine cooling passage. Turbulators 14 are provided as necessary on the inside wall of each of the steam passages 3A to 3D to make the steam flow turbulent and increase the heat transmission.

In the moving blade 1 configured as described above, steam 30 flows into the steam passage 3A at the trailing edge portion through a steam inlet (not shown) at the lower part of a blade root portion, and enters the steam passage 3B at the trailing edge side intermediate portion from the tip end portion. Then, the steam 30 enters the steam passage 3C at the leading edge side intermediate portion from the base portion of the steam passage 3B, and further flows into the steam passage 3D at the leading edge portion from the tip end portion, and flows to the base portion. The steam 30, which cools the blade in this manner, is recovered through a steam outlet (not shown) at the blade root portion, and returned to a steam supply source. At the inlet portion of the steam passage 3A, part of steam flows into steam passages in a platform 2 as described below.

Figure 2:
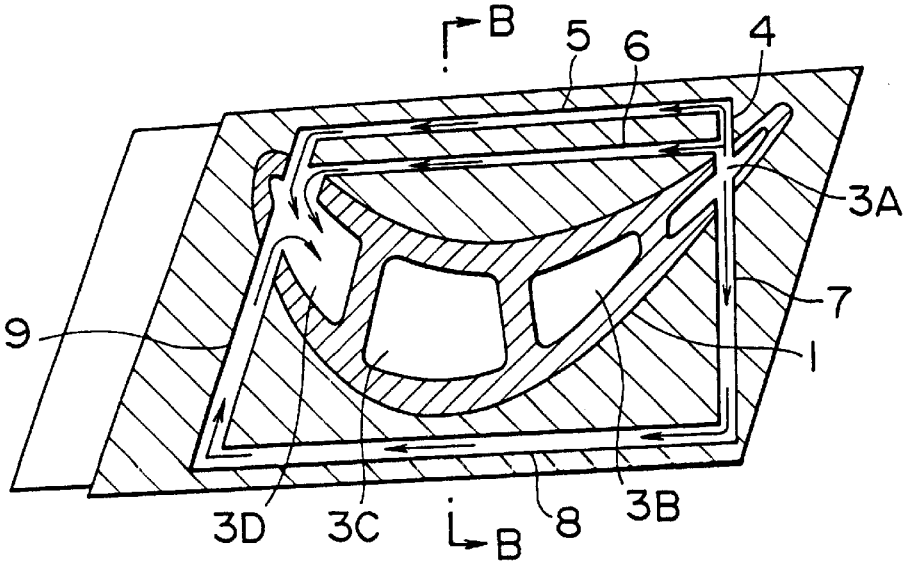
FIG. 2 is a sectional view taken along the line A—A of FIG. 1.
Figure 3:
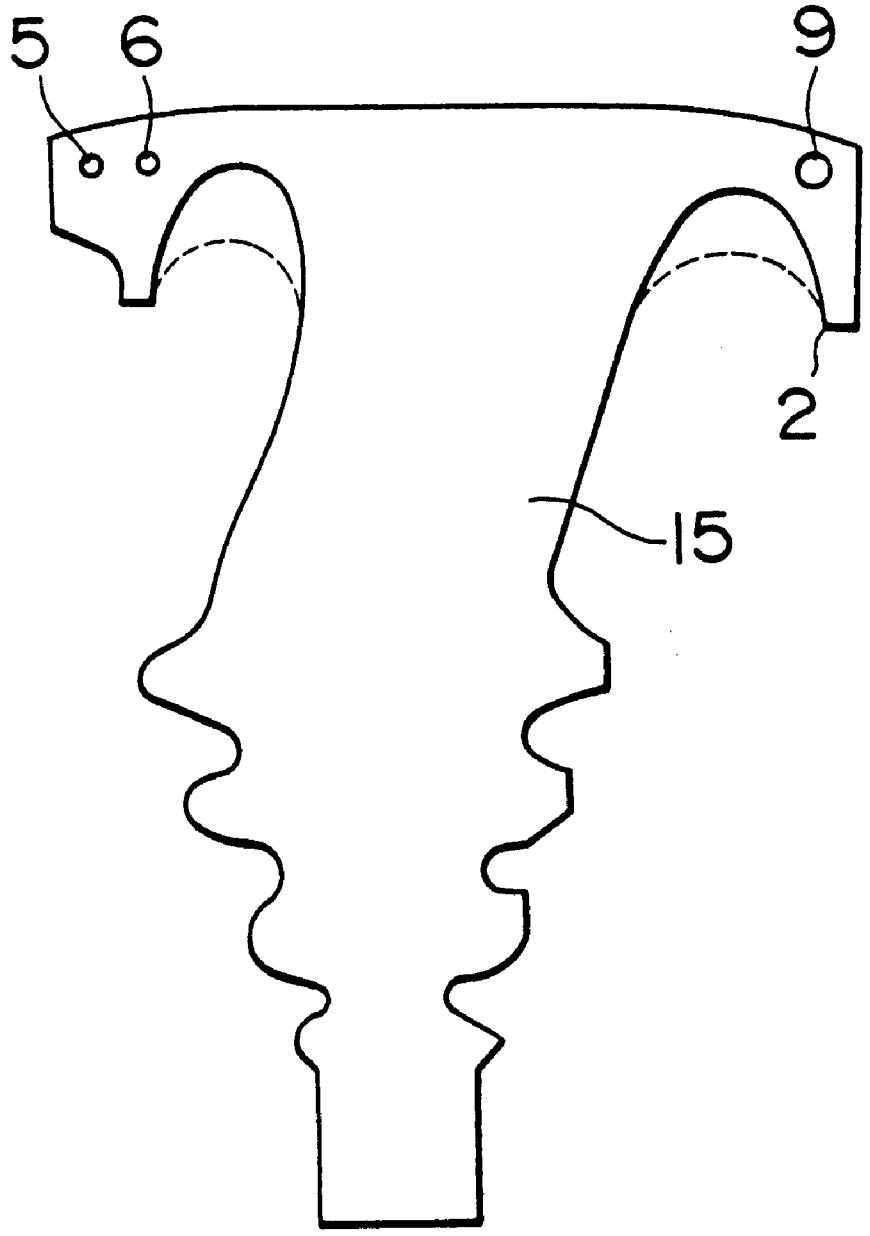
FIG. 3 is a sectional view taken along the line B—B of FIG. 2.
Figure 4:
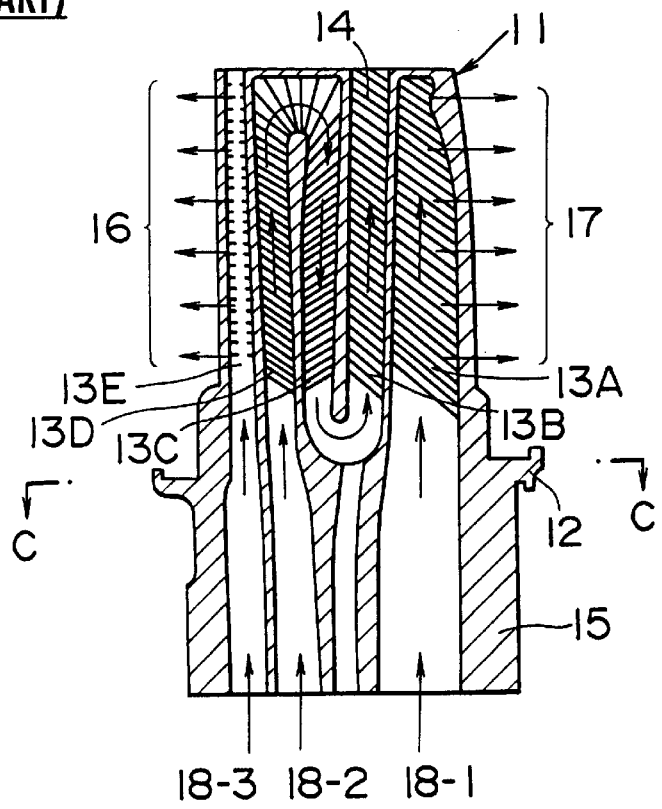
FIG. 4 (PRIOR ART)
FIG. 4 is a sectional view showing the interior of a conventional gas turbine moving blade.
Figure 5:
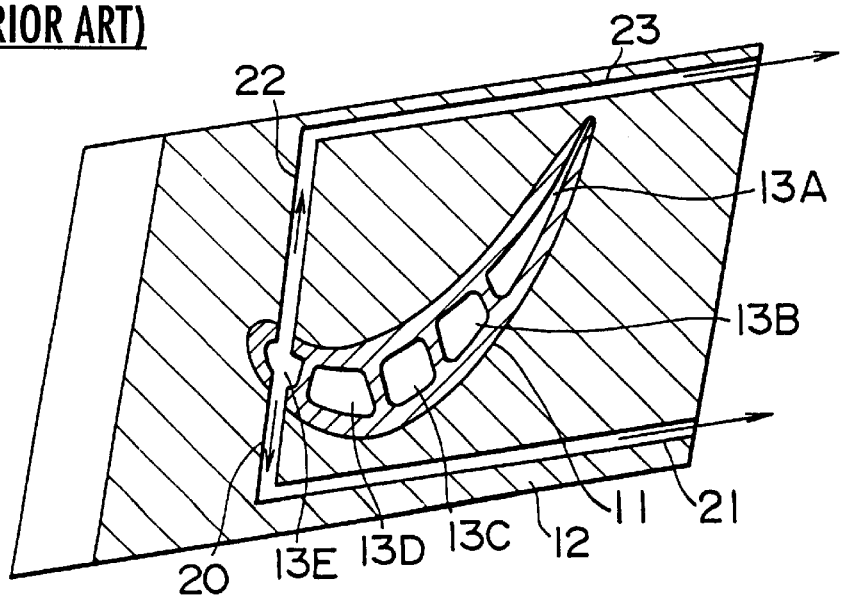
FIG. 5 (PRIOR ART)
FIG. 5 is a sectional view taken along the line C—C of FIG. 4.

FIG. 2 is a sectional view taken along the line A—A of FIG. 1, showing the steam passages in the platform 2. In FIG. 2, first and second steam passages 4 and 7 communicate with the steam passage 3A at the trailing edge portion. The first steam passage 4 connects with third and fourth steam passages 5 and 6, and the second steam passage 7 connects with a fifth steam passage 8. The fifth steam passage 8 further connects with a sixth steam passage 9. These steam passages 5, 6 and 8, 9 connect, at the base portion, with the steam passage 3D at the leading edge portion.

In the platform 2 constructed in such a manner, part of the steam 30 flowing from the base portion of the steam passage 3A at the trailing edge portion flows into the first and second steam passages 4 and 7, and passes through the third, fourth, and fifth steam passages 5, 6 and 8, flowing to the leading edge portion. Thus, the steam 30 cools the peripheral portion of the platform 2, and flows out of the base portion of the steam passage 3D at the leading edge portion, being recovered together with the cooling steam having cooled the blade.

In the above-described embodiment, two steam passages 5 and 6 are provided on one side (the ventral side of blade) of the platform 2, and one steam passage 8 is provided on the other side (the dorsal side of blade) as an example. However, the number of steam passages is not limited to this example, and one or plural number of steam passages may be provided as necessary depending on the space of the platform 2. These steam passages may be formed by making circular holes in the platform. Further, although the flow inlet for the steam 30 is provided on the trailing edge side in FIG. 1, it may be provided on the leading edge side depending on the steam cooling path for the blade.

In the moving blade 1 steam-cooled as described above, the heat capacity must be decreased to the utmost to increase the cooling effect. For this reason, it is preferable to decrease the thickness of the platform 2 at the portions indicated by the dotted lines in FIG. 3.

According to the cooled platform for a gas turbine moving blade of the above embodiment, in a gas turbine in which the moving blade is cooled by steam in place of air, if the platform for the moving blade is constructed as shown in FIG. 2, the platform for the moving blade can also be cooled by steam, so that the gas turbine performance can be increased by using no air.

What is claimed is:

1. A moving blade for a gas turbine, comprising:

said blade leaving an internal passage for carrying s earn through the blade for steam cooling thereof, the blade passage being configured to carry steam into the blade through a radially inner base end of the blade and into a first portion of the passage formed within a edge portion of the blade and to carry steam out of the blade through a second portion of the passage formed within a leading edge portion of the blade and discharging through the base end of the blade;

a platform attached to the base end of the blade, the platform including a peripheral portion surrounding the base end of the blade; and a steam passage formed in the peripheral portion of the platform and connected to the passage in the blade such that a portion o f steam supplied to the blade flows through the steam passage in the platform for cooling thereof, the passage in the platform including passages connected to the first portion of the blade passage for receiving steam therefrom and extending forward along the platform and connected to said second potion of the blade passage for discharging steam thereinto.

2. The moving blade of claim 1 wherein the platform includes a ventral portion located adjacent a ventral side of the blade and a dorsal portion located adjacent a dorsal side of the blade, and wherein the steam passage in the platform includes a steam passage in the ventral portion and a steam passage in the dorsal portion of the platform.

3. The moving blade of claim 1, wherein the platform includes first, second, and third passages, the first passage being connected to the first portion of the blade passage for receiving steam therefrom and extending along a trailing-edge portion of the platform away from a ventral side of the blade, the second and third passages being connected to the first passage and extending forward through the platform along tile ventral side of the blade and discharging into the second portion of the blade passage.

4. The moving blade of claim 3, wherein the platform further includes fourth, fifth, and sixth passages, the fourth passage being connected to the first portion of the blade passage for receiving steam therefrom and extending along the railing-edge portion of the platform away from a dorsal side of the blade, the fifth passage being connected to the fourth passage and extending forward through the platform along the dorsal side of the blade, the sixth passage being connected to a forward end of the fifth passage and extending along a leading-edge portion of the platform and discharging into the second portion of the blade passage.

* * * * *

UNITED STATES PATENT AND TRADEMARK OFFICE

CERTIFICATE OF CORRECTION

PATENT NO. : 6,132,173

DATED : October 17, 2000

INVENTOR(S) : Tomita et al.

It is certified that error appears in the above-identified patent and that said Letters Patent is hereby corrected as shown below:

Column 4, line 13, "leaving" should read --having--; "s earn" should read --steam--; line 17, before "edge" insert --trailing--; line 27, "o f" should read --of--; line 32, "potion" should read --portion--; line 47, "tile" should read --the--; line 53, "railing-edge" should read --trailing-edge--.

Signed and Sealed this

Eighth Day of May, 2001

*Attest:*

Nicholas P. Godici

NICHOLAS P. GODICI

*Attesting Officer*

*Acting Director of the United States Patent and Trademark Office*